US008966711B2

(12) United States Patent
Millington et al.

(10) Patent No.: US 8,966,711 B2
(45) Date of Patent: Mar. 3, 2015

(54) CLEANER HEAD FOR A SURFACE TREATING APPLIANCE

(75) Inventors: David Alan Millington, Malmesbury (GB); Stephen Robert Dimbylow, Malmesbury (GB); Peter David Gammack, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 418 days.

(21) Appl. No.: 13/372,102

(22) Filed: Feb. 13, 2012

(65) Prior Publication Data

US 2012/0216361 A1 Aug. 30, 2012

(30) Foreign Application Priority Data

Feb. 28, 2011 (GB) ..... 1103366.9

(51) Int. Cl.
*A47L 5/36* (2006.01)
*A47L 9/02* (2006.01)
*A47L 9/24* (2006.01)

(52) U.S. Cl.
CPC .. *A47L 9/242* (2013.01); *A47L 5/36* (2013.01); *A47L 9/02* (2013.01)
USPC ..... 15/411; 15/327.1; 15/415.1

(58) Field of Classification Search
CPC ..... A47L 5/36; A47L 9/02
USPC ..... 15/327.1, 411, 415.1
IPC ..... A47L 5/36, 9/02, 9/24
See application file for complete search history.

(56) References Cited

U.S. PATENT DOCUMENTS

2006/0137134 A1 6/2006 Dilger et al.

FOREIGN PATENT DOCUMENTS

| | | |
|---|---|---|
| EP | 1 674 012 | 6/2006 |
| GB | 2470920 | 12/2010 |
| JP | 11-155786 | 6/1999 |
| JP | 2000-83879 | 3/2000 |
| JP | 2001-169977 | 6/2001 |
| JP | 2003-153833 | 5/2003 |
| JP | 2009-543626 | 12/2009 |
| JP | 2010-22855 | 2/2010 |

(Continued)

OTHER PUBLICATIONS

Search Report and Written Opinion mailed Mar. 29, 2012, directed to International Patent Application No. PCT/GB2012/050084; 10 pages.

(Continued)

*Primary Examiner* — David Redding
(74) *Attorney, Agent, or Firm* — Morrison & Foerster LLP

(57) ABSTRACT

A cleaner head for a surface treating appliance includes a main body, a front conduit, and a rear conduit. The front conduit includes a front section connected to the main body for rotation relative thereto about a first axis extending rearwardly from the main body and centrally through the front section, a rear elbow section and at least one first connector. The rear conduit includes a front elbow section into which the rear elbow section of the front conduit is inserted, a rear section and at least one second connector connected to said at least one first connector to enable the rear conduit to pivot relative to the front conduit about a second axis which is orthogonal to the first axis and which lies outside a fluid flow path passing through the front conduit and the rear conduit.

22 Claims, 5 Drawing Sheets

(56) References Cited

FOREIGN PATENT DOCUMENTS

| | | |
|---|---|---|
| JP | 2010-284529 | 12/2010 |
| WO | WO-02/071911 | 9/2002 |
| WO | WO-2007/033915 | 3/2007 |
| WO | WO-2008/009583 | 1/2008 |

OTHER PUBLICATIONS

GB Search Report mailed Jun. 24, 2011, directed to GB Application No. 1103366.9; 2 pages.

CLEANER HEAD FOR A SURFACE TREATING APPLIANCE

REFERENCE TO RELATED APPLICATIONS

This application claims the priority of United Kingdom Application No. 1103366.9, filed Feb. 28, 2011, the entire contents of which are incorporated herein by reference.

FIELD OF THE INVENTION

The present invention relates to a cleaner head for a surface treating appliance. In its preferred embodiment, the present invention relates to a cleaner head for a vacuum cleaning appliance.

BACKGROUND OF THE INVENTION

Vacuum cleaners are generally supplied with a range of tools for dealing with specific types of cleaning. The tools include a cleaner head for general on-the-floor cleaning. The cleaner head comprises a main body which engages with a floor surface. The main body has a lower surface comprising a suction opening through which, in use, dirt and dust is drawn into the cleaner head from the floor surface.

It is useful for the main body to be pivotably connected to the remainder of the cleaner head so that the suction opening can remain in close proximity to the floor surface as the cleaner head is maneuvered over the floor surface.

For example, JP 11-155786 describes a cleaner head having a main body and a conduit assembly connected to the main body for conveying an air flow away from the main body. The main body comprises a suction opening located in a lower surface of the main body, and which lies in a suction plane. The conduit assembly is connectable to a wand of a vacuum cleaner, which has a handle which is manipulated by the user to maneuver the floor tool over the floor surface. The conduit assembly comprises a generally tubular front conduit having a circular air inlet which is connected to the rear of the main body for rotation about a first axis which extends rearwardly from the main body parallel to the suction plane and through the bore of the front conduit. An air outlet extends from midway along the upper surface of the front conduit to the rear of the front conduit. The conduit assembly further comprises a rear conduit which is connected to the front conduit for pivotal movement relative to the front conduit about a second axis which is orthogonal to the first axis and parallel to the suction plane. Opposing recesses are provided on the internal surface of the front conduit lying adjacent the front of the air outlet for receiving the ends of a shaft located on the upper surface of the front of the rear conduit. With the ends of the shaft received within the recesses, the rear conduit can move within the front conduit and about the second axis between raised and lowered positions.

Through combinations of a rotation of the front conduit about the first axis and a rotation of the rear conduit about the second axis, the conduit assembly is able to adopt different configurations relative to the main body to facilitate the maneuvering of the main body over a floor surface, and between and beneath items of furniture. However, as the pivoting connection between the front and rear conduits is located within an airflow path passing through the conduits, there is a risk of air leaking around the connection, reducing the pick-up performance of the cleaner head. The presence of such a connection within the airflow path can disrupt the air flow through the conduit assembly, which can generate turbulence and noise.

SUMMARY OF THE INVENTION

In a first aspect the present invention provides a cleaner head for a surface treating appliance, comprising a main body having a fluid port located at the rear of the main body, a front conduit comprising a front section connected to the main body for rotation relative thereto about a first axis extending rearwardly from the main body and through the fluid port and the front section, a rear elbow section and at least one first connector, and a rear conduit comprising a front elbow section moveable within or about the rear elbow section of the front conduit, a rear section and at least one second connector connected to said at least one first connector to enable the rear conduit to pivot relative to the front conduit about a second axis which is orthogonal to the first axis and which lies outside a fluid flow path passing through the front conduit and the rear conduit.

As the connectors for connecting together the front conduit and the rear conduit lie outside a fluid flow path passing through the conduits, the connectors may have any desired configuration without requiring any seals for preventing fluid from leaking between the connectors. In a preferred embodiment, the front conduit comprises a pair of arms which extend towards the rear conduit, and the rear conduit comprises a shaft which is received between the arms. A bolt, pin or other connecting member may be provided for connecting the shaft to the arms so that the shaft can rotate relative to the arms. Alternative, the connectors may be connected together by means of a snap-fit connection. A relatively simple seal may then be provided between the elbow sections to prevent fluid from leaking between the elbow sections.

The front section of the rear conduit is preferably inserted into the rear section of the front conduit. As the rear conduit is inserted into the front conduit, at least the front section of the rear conduit has a greater cross-sectional area that the rear section of the front conduit. In a preferred embodiment, the cleaner head is used as part of a cleaning appliance in which fluid flows from the front conduit to the rear conduit. As the fluid flow enters the rear conduit, the fluid flow does not impinge on the front end of the rear conduit, which would disrupt the fluid flow through the conduits and generate noise, but instead passes into a region having a greater cross-sectional area.

The elbow sections preferably have substantially the same curvature so that a seal may be readily maintained between the elbow sections as the rear conduit is moved relative to the front conduit. For example, an annular sealing member may be located on the outer surface of the rear elbow section of the front conduit for engaging the inner surface of the front elbow section of the rear conduit as the rear conduit is pivoted relative to the front conduit. Alternatively, a sealing member may be disposed on the inner surface of the front elbow section for engaging the outer surface of the rear elbow section. The inner surface of the front section of rear conduit preferably has a diameter which is only slightly greater than that of the outer surface of the rear section of the front conduit so that the rear section of the front conduit can guide the movement of the front section of the rear conduit relative thereto as the rear conduit is pivoted and with minimal wobbling of the rear conduit relative to the front conduit to minimize the risk of fluid leaking between the conduits. Preferably, the inner surface of the front elbow section of the rear conduit slides over the outer surface of the rear elbow section of the front conduit as the rear conduit pivots relative to the front conduit.

The front end of the front elbow section of the rear conduit preferably moves between the front end and the rear end of the rear elbow section of the front conduit as the rear conduit pivots between raised and lowered positions relative to the front conduit. In this case, the curvature of the elbow sections can determine the extent to which the rear section can pivot relative to the front section. The curvature of each elbow section is preferably at least 60°, and in a preferred embodiment each elbow section has a generally 90° curvature. When the cleaner head is located on a substantially horizontal surface, the rear section of the rear conduit may then move between a relatively horizontal position and a relatively vertical position as the rear conduit pivots relative to the front conduit.

The front section of the front conduit is preferably also horizontal when the rear conduit is in a lowered position relative to the front conduit. This can enable a conduit assembly comprising the front and rear conduits to have a relatively low profile when the rear conduit is in a lowered position. Each conduit preferably comprises a curved intermediate section located between the front section and the rear section thereof, with each intermediate section preferably having a curvature in the range from 40 to 50° to allow the conduit assembly to have a low profile.

Each conduit may comprise a number of tubes or pipes which are connected together and each provide a respective section of the conduit. Alternatively, each conduit may be a single tube or pipe providing the different sections of the conduit.

The cleaner head preferably comprises a chassis for supporting the front conduit on a surface. The chassis is preferably connected to the front conduit for rotation therewith about the first axis. The chassis may extend about the front conduit, and about the connectors for connecting together the front and rear conduits to inhibit the ingress of dirt between the connectors.

The chassis preferably comprises a body, and a pair of wheels supported by the body. Contact between the rear conduit and the chassis may limit the movement of the rear conduit away from the lowered position. The body may comprise a recessed portion for receiving the rear conduit with pivoting movement thereof about the second axis so that the chassis does not inhibit movement of the rear conduit until the rear conduit has reached, or moved beyond, the desired raised position. This can allow the chassis to be located adjacent the rear conduit, and so allow the conduit assembly to be relatively compact to minimize the length of the cleaner head.

The cleaner head may comprise a shield member for inhibiting the ingress of dirt into the body of the chassis through the recess when the rear conduit is not in the raised position. The shield member preferably moves with the rear conduit as it pivots between the raised and lowered positions. For example, the shield member may be connected to the rear conduit. Alternatively, the shield member may be pivotably connected to the body of the chassis, and may be biased towards the rear conduit. The shield member may be pivotable about a third axis which intersects orthogonally the first axis. The shield member is preferably disposed between the recessed portion of the body and the rear conduit.

The shield member and the recessed portion of the body may each have a curved outer surface, with the curvature of the outer surface of the shield member preferably being substantially the same as the curvature of the recessed portion of the body. The wheels of the chassis are preferably dome-shaped, and preferably have a substantially spherical curvature. The curvature of the outer surface of the wheels is preferably substantially the same as the curvature of the outer surface of the recessed portion of the body so that the outer surfaces of the body and the wheels of the chassis are located on the surface of a common sphere. The third axis, about which the shield member pivots relative to the body of the chassis, preferably passes through the center of this sphere. As the shield member becomes exposed as the rear conduit moves away from the raised position, the similar curvatures of the shield member and the body of the chassis means that the emergence of the shield member does not disrupt unduly the spherical appearance of the chassis.

The cleaner head may be used with any cleaning or surface treating appliance that carries fluid to and/or from a surface, e.g. wet/dry vacuum cleaners, polishing/waxing machines and carpet shampoo machines.

In a second aspect, the present invention provides a conduit assembly for a cleaner head of a surface treating appliance, the conduit assembly comprises a front conduit, a rear conduit pivotably connected to the front conduit for movement between a raised position and a lowered position, and a chassis for supporting the front conduit, the chassis comprising a body and a pair of wheels rotatably connected to the body, the body having a recessed portion for receiving the rear conduit as the rear conduit moves towards the raised position, the chassis further comprising a shield member for covering a gap formed between the rear conduit and the recessed portion of the body as the rear conduit moves away from the raised position.

Features described above in connection with the first aspect of the invention are equally applicable to the second aspect of the invention, and vice versa.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 1:
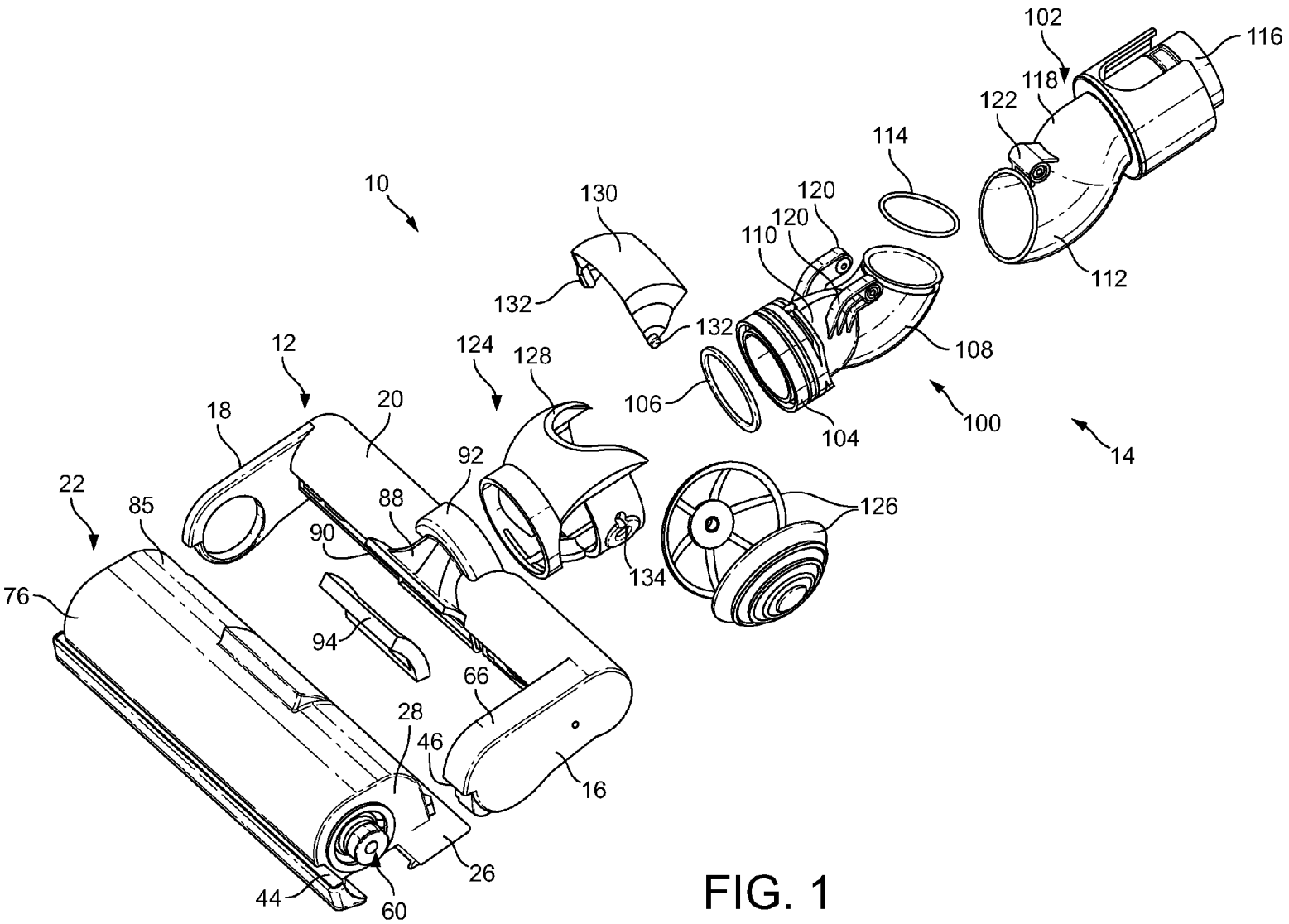
FIG. 1 is an exploded view of a cleaner head.

FIGS. 1 to 4 illustrate an embodiment of a cleaner head for a surface treating appliance. In this embodiment, the cleaner head 10 is arranged to be connectable to a wand or hose of a cylinder vacuum cleaning appliance. The cleaner head 10 comprises a main body 12 and a conduit assembly 14 connected to the main body 12. The main body 12 comprises substantially parallel side walls 16, 18 extending forwardly from opposite ends of a rear section 20 of the main body 12, and a moveable section 22 located between the side walls 16, 18 of the main body 12. In this embodiment the moveable section 22 is rotatably connected to the main body 12 for rotation about an axis which extends generally orthogonally between the side walls 16, 18 of the main body 12.

The moveable section 22 comprises an upper wall 24, a lower plate, or sole plate 26, and two side walls 28 which connect the sole plate 26 to the upper wall 24. The side walls 28 are located between the side walls 16, 18 of the main body 12, with each side wall 28 being located adjacent and substantially parallel to a respective one of the side walls 16, 18 of the main body 12. In use, the sole plate 26 faces the floor surface to be cleaned and engages the surface of a carpeted floor surface.

Figure 3:
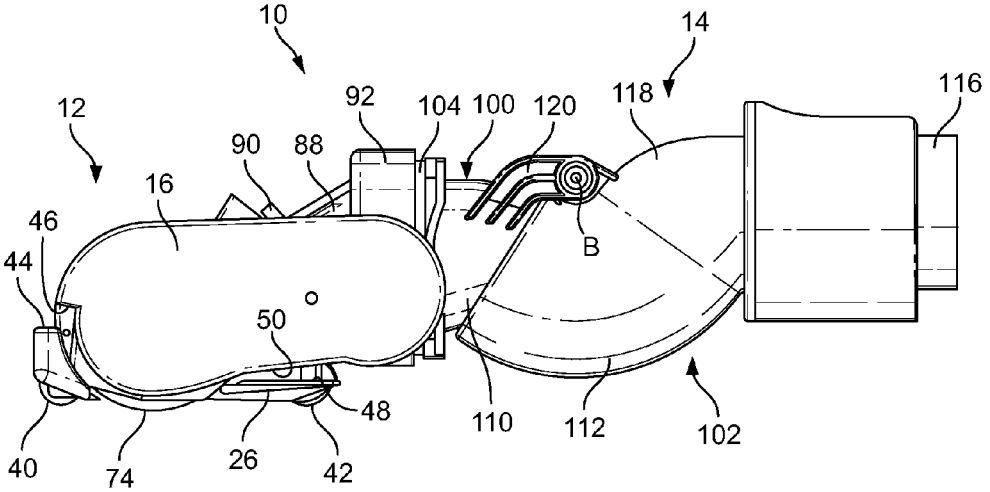
FIG. 3 is a side view of the cleaner head with the rear conduit in the lowered position, and with a chassis of the cleaner head removed to reveal a front conduit of the cleaner head.
Figure 4:
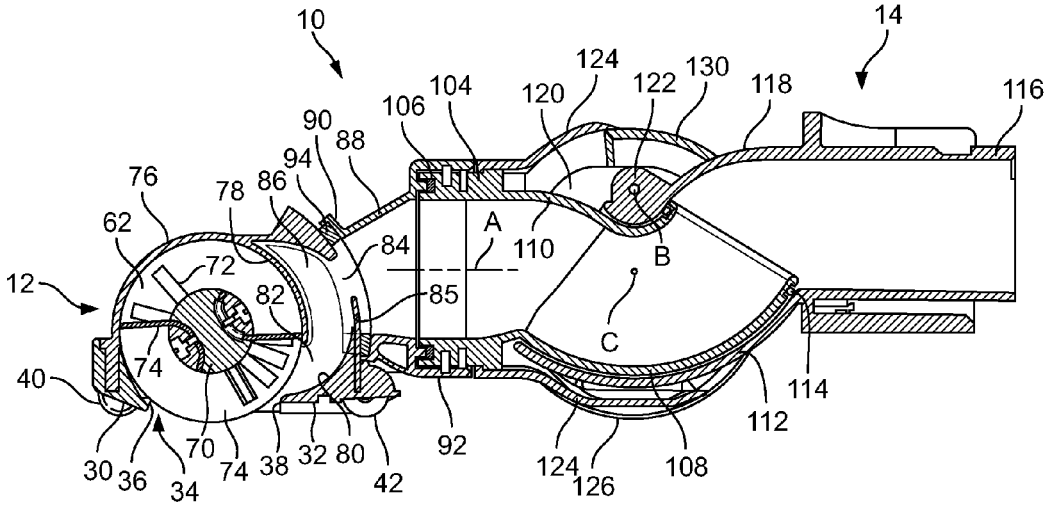
FIG. 4 is a side sectional view along line A-A in FIG. 2.

With particular reference to FIGS. 3 and 4, the sole plate 26 comprises a leading section 30 and a trailing section 32 located on opposite sides of a suction opening 34 through which a dirt-bearing air flow enters the cleaner head 10. The suction opening 34 is generally rectangular in shape. The sole plate 26 comprises two working edges 36, 38 on opposing long sides of the suction opening 34 for agitating the fibers of a carpeted floor surface as the cleaner head 10 is maneuvered over such a surface. To prevent the working edges 36, 38 from scratching or otherwise marking a hard floor surface as the cleaner head 10 is maneuvered over such a surface, the cleaner head 10 comprises surface engaging support members which serve to space the working edges 36, 38 from a hard floor surface. In this embodiment, the cleaner head 10 comprises a plurality of surface engaging support members which are each in the form of a rolling element, preferably a wheel. A first pair of wheels 40 is rotatably mounted within a pair of recesses formed in the leading section 30 of the sole plate 26, and a second pair of wheels 42 is rotatably mounted within a pair of recesses formed in the trailing section 32 of the sole plate 26.

During use, a pressure difference is generated between the air passing through the cleaner head 10 and the external environment. This pressure difference generates a force which acts downwardly on the cleaner head 10 towards the floor surface. When the cleaner head 10 is located on a carpeted floor surface, the wheels 40, 42 are pushed into the fibers of the carpeted floor surface under the weight of the cleaner head 10 and the force acting downwardly on the cleaner head 10. The thickness of the wheels 40, 42 is selected so that the wheels 40, 42 will readily sink into the carpeted floor surface to bring at least the working edges 36, 38 of the sole plate 26 into contact with the fibers of the floor surface.

As the cleaner head 10 is pulled backwards over a carpeted floor surface by a user, there is a tendency for the user to raise the rear section 20 of the main body 12 of the cleaner head 10. However, the rotatable connection of the moveable section 22 to the main body 12 allows the sole plate 26 to pivot relative to the main body 12 to maintain the working edges 36, 38 in contact with the floor surface. Clockwise rotation of the moveable section 22 relative to the main body 12 is restricted through the abutment of upwardly facing surfaces 44 located on the moveable section 22 with downwardly facing surfaces 46 located towards the front of the side walls 16, 18 of the main body 12. Anticlockwise rotation of the moveable section 22 relative to the main body 12 is restricted through the abutment of the upper surface 48 of the trailing section 32 of the sole plate 26 with the bottom surfaces 50 of the side walls 16, 18 of the main body 12.

The cleaner head 10 further comprises an agitator assembly for agitating dirt and dust located on the floor surface. In this example the agitator assembly comprises a rotatable brush bar 60 which is mounted within an agitator chamber 62 of the moveable section 22 of the main body 12. The agitator chamber 62 is partially defined by the upper wall 24 of the moveable section 22. The upper wall 24 is preferably formed from transparent material to allow the user to see whether the agitator chamber 62 has become blocked. The brush bar 60 is driven by a motor (not shown) located in the rear section 20 of the main body 12. The motor may be electrically connected to a terminal located in the conduit assembly 14 for connection with a conformingly profiled terminal located in a duct of the cleaning appliance to enable electrical power to be supplied to the motor. Alternatively, the motor may be driven by power supplied from a battery located in the rear section 20 of the main body 12.

The brush bar 60 is connected to the motor by a drive mechanism located, at least in part, within a drive mechanism housing 66 so that the drive mechanism is isolated from the air passing through the suction passage. One end of the brush bar 60 is connected to the drive mechanism to enable the brush bar 60 to be driven by the motor, whereas the other end of the brush bar 60 is rotatably supported by an end cap (not shown) removably connected to the side wall 18 of the main body 12. The drive mechanism comprises a drive pulley which is connected to a drive shaft rotated by the drive motor, and a driven pulley which is connected to the drive pulley by a belt. A drive dog is mounted on one side of the driven pulley for connection to the brush bar 60.

The brush bar 60 comprises an elongate body 70. The brush bar 60 is rotated about the longitudinal axis of the elongate body 70 by the drive mechanism. The elongate body 70 bears two different types of bristles for agitating dirt and dust from the floor surface as the brush bar 60 is rotated by the motor. Each of the different types of bristles protrudes from the suction opening 34 in the sole plate 26 by respective different amounts as the brush bar 60 is rotated by the motor. In this embodiment, the brush bar 60 comprises relatively short, preferably relatively stiff, bristles 72, and relatively long, preferably relatively soft, bristles 74. The relatively short bristles 72 are arranged in two angularly spaced, helical rows extending along the body 70. Within each row, the relatively short bristles 72 are arranged in a series of clusters or tufts regularly spaced along the row. The relatively long bristles are arranged in two continuous helical rows, with each row being angularly spaced from a row of tufts formed from the relatively short bristles 72.

The length of the relatively short bristles 72 is chosen so that, as the brush bar 60 is rotated, the tips of these bristles 72 protrude outwardly beyond a first plane containing the suction opening 34, but not beyond a second plane containing the lowermost extremities of the wheels 40, 42. The relatively long bristles 74 protrude radially outwardly from the body 70 beyond the relatively short bristles 72 so that the relatively long bristles 74 protrude beyond both the first plane and the second plane during rotation of the brush bar 60.

When the cleaner head 10 is located on a carpeted floor surface the wheels 40, 42 sink between the fibers of the carpet so that the bottom surface of the sole plate 26 engages the fibers of the carpet. As both the relatively short bristles 72 and the relatively long bristles 74 protrude from the suction opening 26 as the brush bar 60 rotates, both of the different types of bristles are able to agitate dirt and dust from the floor surface. When an air flow is generated through the cleaner head 10, by operation of a fan unit of a vacuum cleaning appliance to which the cleaner head 10 is connected, this dirt and dust becomes entrained within the air flow and is conveyed into the cleaner head 10 through the suction opening 34.

When the cleaner head 10 is moved from the carpeted floor surface on to a hard floor surface, the sole plate 26 becomes spaced from the hard floor surface by the wheels 40, 42. As the tips of the relatively short bristles 72 do not protrude beneath the plane containing the lowermost extremities of the wheels 40, 42, these bristles do not come into contact with the hard floor surface, thereby preventing scratching or other marking of the hard floor surface by these bristles. However, as the relatively long bristles 74 protrude beyond this plane, these bristles engage, and are swept across, the hard floor surface with rotation of the brush bar 60 to dislodge dirt and dust from the floor surface to become entrained within the air flow.

The suction opening 34 provides an opening through which dirt, dust particles and other debris is swept into the agitator chamber 62 by the rotating bristles 72, 74 of the brush bar 60. In this example, the motor and drive mechanism are arranged to rotate the brush bar 60 in such a direction that the bristles 72, 74 sweep dirt and dust rearwardly, that is, over the rear working edge 38, into the agitator chamber 62. The agitator chamber 62 is bounded by a curved front section 76 of the upper wall 24, the sole plate 26, the side walls 28, and a curved inner wall 78 connected to the upper wall 24. The front section 76 of the upper wall 24 and the inner wall 78 are in the form of a section of a cylinder, which is substantially co-axial with the rotational axis of the brush bar 60. The lower end of the inner wall 78 is spaced from the upper surface 80 of the sole plate 26 to define a dust outlet 82 from the agitator chamber 62. In this example the lower end of the inner wall 78 is generally straight, and extends substantially the entire length of the agitator chamber 62 so that the height of the dust outlet 82 is substantially constant along the length of the agitator chamber 62.

An exhaust port 84 is formed in the rear section 85 of the upper wall 24. In this example the exhaust port 84 is located midway between the side walls 28. A dust channel 86 extends between the dust outlet 82 of the agitator chamber 62 and the exhaust port 84 to convey dust and debris to the exhaust port 84. The dust channel 86 is generally in the shape of a curved funnel having a relatively wide mouth and a relatively narrow outlet. The dust channel 86 defines part of an air flow path which extends through the cleaner head 10, and along which air is drawn by the motor and fan unit of a vacuum cleaning appliance to which the cleaner head is attached. The air flow path extends from the suction opening 34, through the dust outlet 82 of the agitator chamber 62 and through the dust channel 86 to the exhaust port 84.

The rear section 20 of the main body 12 includes an air channel 88 passing centrally therethrough for conveying an air flow from the moveable section 22 of the main body 12 to the conduit assembly 14. The air channel 88 comprises an inlet port 90 for receiving the air flow from the exhaust port 84, and an outlet port 92. A sealing member 94 is located between the rear section 20 and the moveable section 22 of the main body 12 to maintain an air tight seal between the exhaust port 84 and the inlet port 90 as the moveable section 22 pivots relative to the rear section 20. The outlet port 92 is generally circular, and is oriented so that when the cleaner head 10 is located on a hard floor surface with the upper surface 48 of the trailing section 32 of the sole plate 26 abutting the bottom surfaces 50 of the side walls 16, 18 of the main body 12, the outlet port 92 is substantially orthogonal to the second plane containing the lowermost extremities of the wheels 40, 42.

The conduit assembly 14 is connected to the rear section 20 of the main body 12. The conduit assembly 14 comprises a front conduit 100 for receiving the air flow from the outlet port 92 of the main body 12, and a rear conduit 102 for receiving the air flow from the front conduit 100. The rear conduit 102 is connectable to the wand or hose of a vacuum cleaning appliance for receiving the air flow from the conduit assembly 14.

The front conduit 100 comprises a front section 104 which is connected to the main body 12. The front section 104 is generally cylindrical in shape. The front section 104 is inserted into the outlet port 92, and is connected to the outlet port 92, for example by a C-clip or a snap-fit connection, so that the front conduit 100 is able to rotate relative to the main body 12. An annular sealing member 106 is located between the front section 104 and the outlet port 92 to maintain an air tight seal between the main body 12 and the conduit assembly 14. The front conduit 100 is rotatable relative to the main body 12 about a first axis A, indicated in FIGS. 2 and 4, which extends rearwardly from the main body 12 and centrally through the outlet port 92 and the front section 104 of the front conduit 100. The first axis A is substantially orthogonal to the rotational axis of the brush bar 60.

The front conduit 100 further comprises a rear elbow section 108 from which the air flow enters the rear conduit 102. The rear elbow section 108 has a generally 90° curvature, and extends about a second axis B indicated in FIGS. 3 and 4. The second axis B is orthogonal to the first axis A. The rear elbow section 108 is connected to the front section 104 by a curved intermediate section 110. The intermediate section 110 has a smaller curvature than the rear elbow section 108, and in this embodiment the angle of curvature is around 40°.

The rear conduit 102 comprises a front elbow section 112 into which the rear elbow section 108 of the front conduit 100 is inserted. The elbow sections 108, 112 preferably have substantially the same curvature, and so the front elbow section 112 has a generally 90° curvature. The front elbow section 112 also extends about a second axis B indicated in FIGS. 3 and 4. An annular sealing member 114 is located about the outer periphery of the rear elbow section 108 of the front conduit 100 for forming an air tight seal with the inner surface of the front elbow section 112 of the rear conduit 102.

The rear conduit further comprises a rear section 116 which is connectable to a wand or hose of a vacuum cleaning appliance. The rear section 116 is generally cylindrical in shape. The front elbow section 112 is connected to the rear section 116 by a curved intermediate section 118. As above, the intermediate section 118 has a smaller curvature than the front elbow section 112, and in this embodiment the angle of curvature is around 50°.

Figure 2:
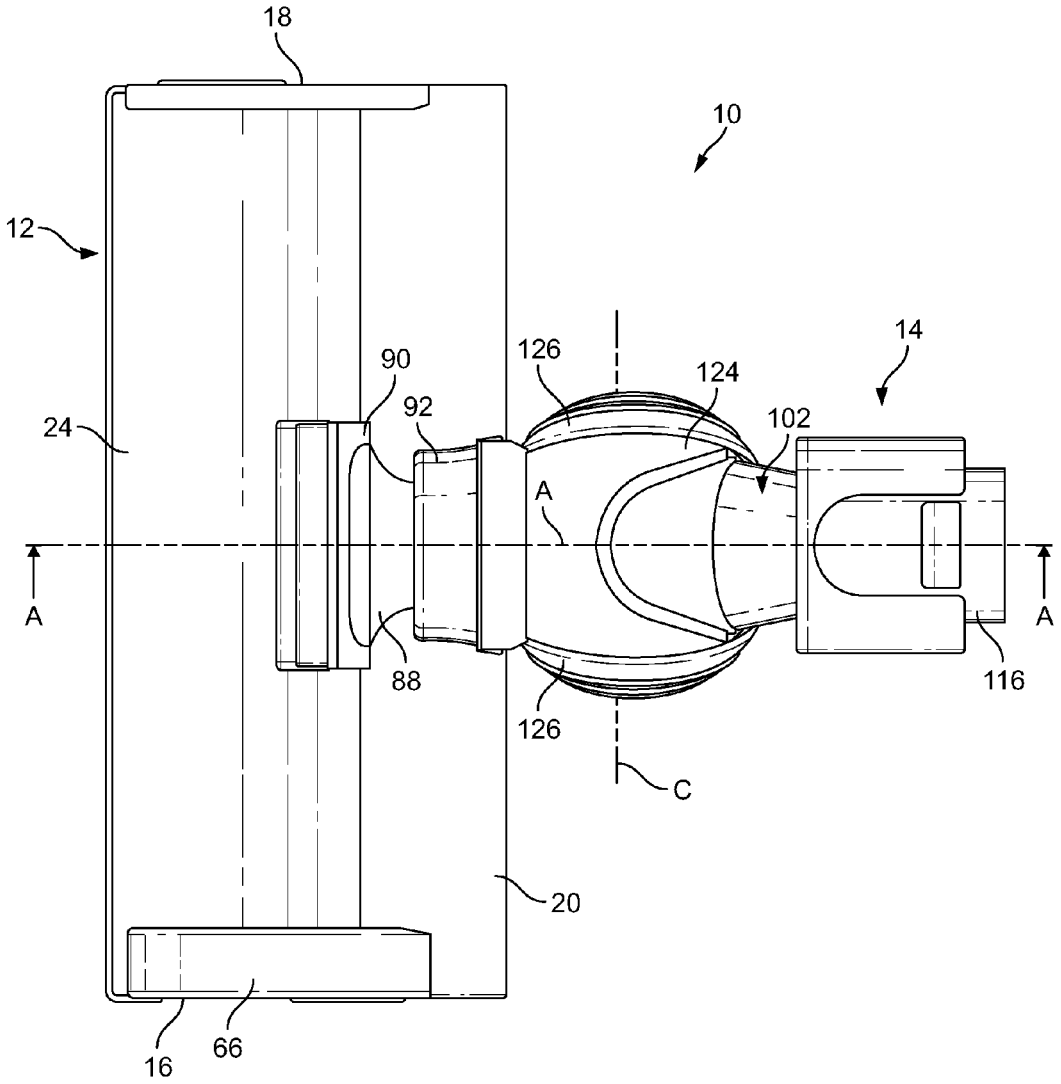
FIG. 2 is a top view of the cleaner head, with a rear conduit of the cleaner head in a lowered positioned.
Figure 5:
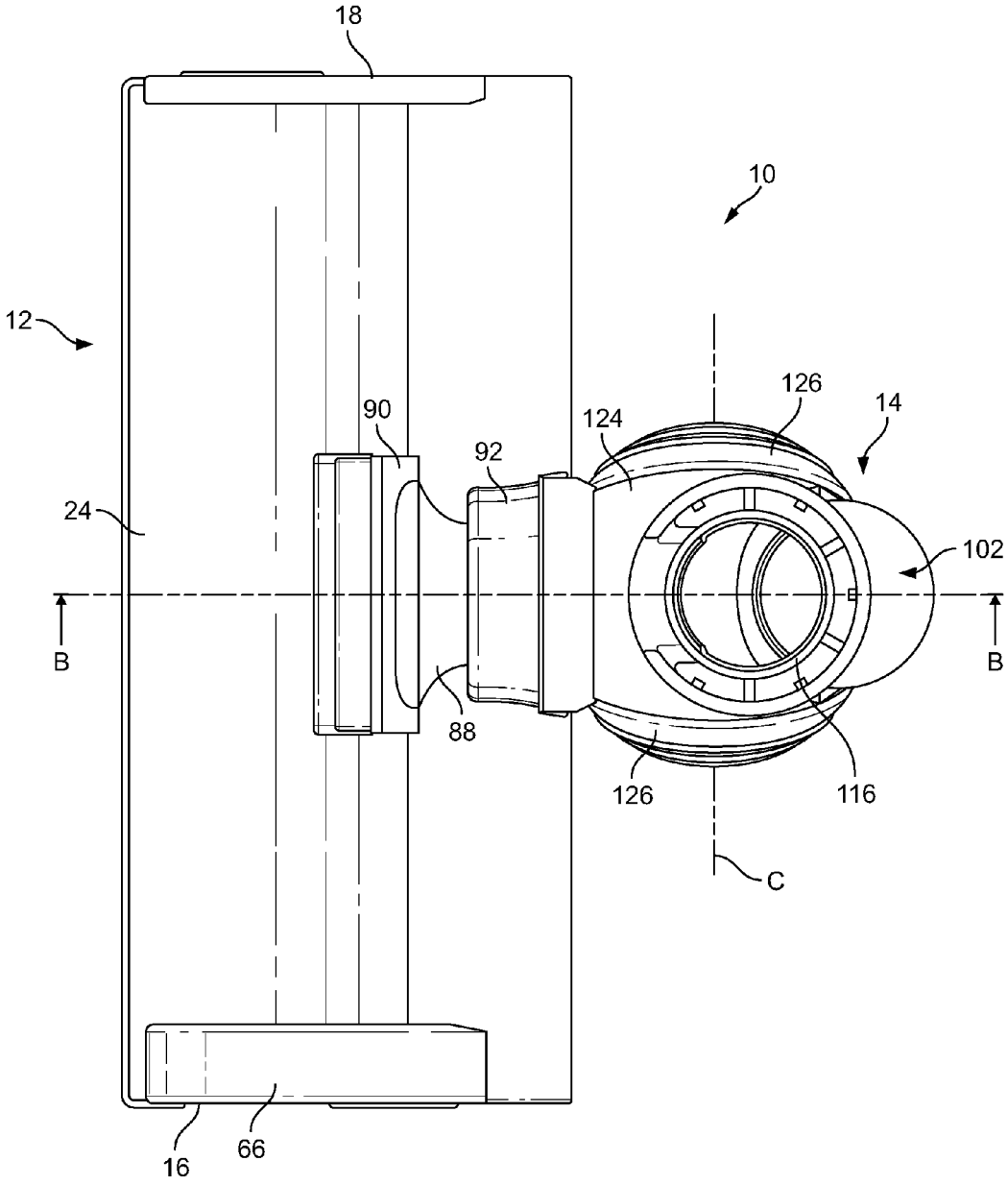
FIG. 5 is a top view of the cleaner head, with the rear conduit in a raised positioned.
Figure 6:
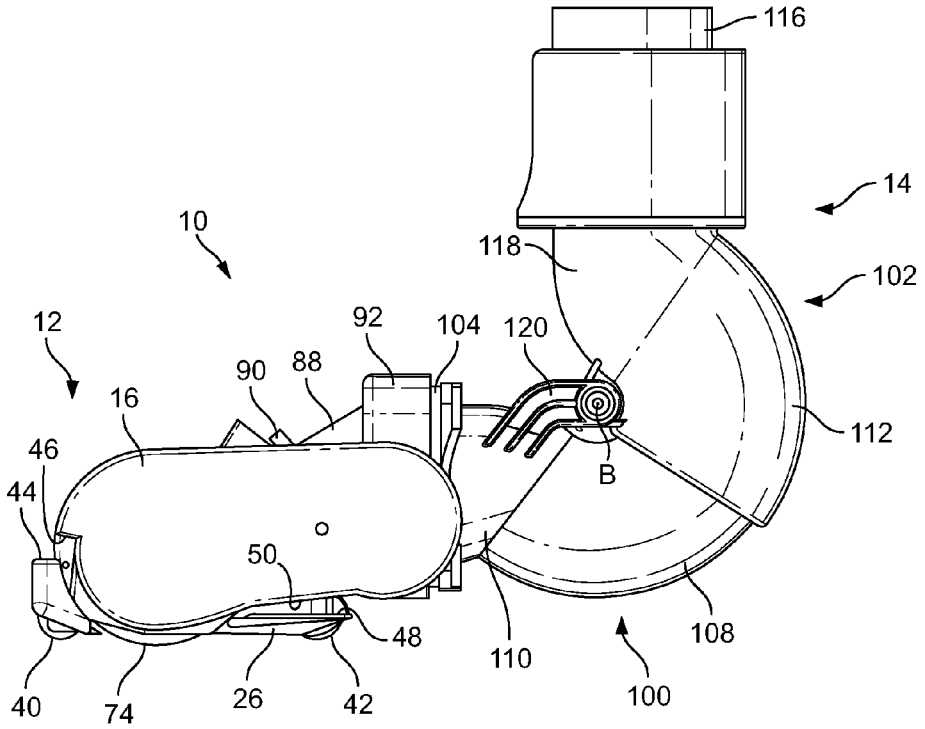
FIG. 6 is a side view of the cleaner head with the rear conduit in the raised position, and with a chassis of the cleaner head removed to reveal a front conduit of the cleaner head.
Figure 7:
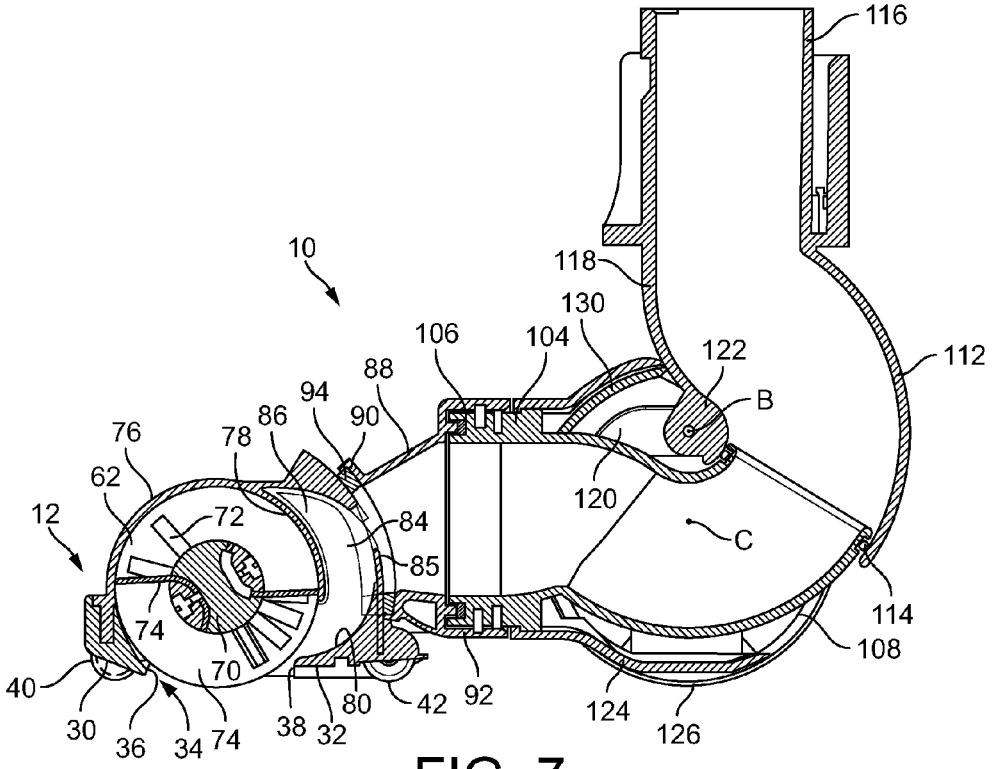
FIG. 7 is a side sectional view along line B-B in FIG. 5.

The rear conduit 102 is connected to the front conduit 100 so that the rear conduit 102 can pivot relative to the front conduit 100. The rear conduit 102 is moveable relative to the front conduit 100 between a lowered position, as illustrated in FIGS. 2 to 4, in which the rear section 116 of the rear conduit 102 is generally parallel to the front section 104 of the front conduit 100, and a raised position, as illustrated in FIGS. 5 to 7, in which the rear section 116 of the rear conduit 102 is generally orthogonal to the front section 104 of the front conduit 100. When the rear conduit 102 is in the lowered position, the rear elbow section 108 of the front conduit 100 is substantially fully surrounded by the front elbow section 112 of the rear conduit 102. In this lowered position of the rear conduit 102, the front end of the front elbow section 112 of the rear conduit 102 abuts against the outer wall of the intermediate section 110 of the front conduit 100.

The rear conduit 102 is connected to the front conduit 100 so that the rear conduit 102 can pivot relative to the front conduit 100 about the second axis B. In this example, the front conduit 100 comprises a pair of arms 120 which extend rearwardly towards the rear conduit 102 from the intermediate section 110 of the front conduit 100. The rear conduit 102 comprises a shaft 122 which is received between the arms 120, and which is secured to the arms 120 by a pin or rod (not shown) which is inserted through apertures formed in the arms 120 and the shaft 122 so that the shaft 122 is rotatable about the second axis B. Of course, the connections between the front conduit 100 and the rear conduit 102 may be reversed, so that the arms 120 are located on the rear conduit 102 and the shaft 122 is located on the front conduit 100.

The pivoting connection between the front conduit 100 and the rear conduit 102 is thus located external of an air flow path passing through the conduit assembly 14. This means that the connection between the front conduit 100 and the rear conduit 102 can be made in any desired manner without concern of any leakage of air from around or between components of this connection. As the rear conduit 102 moves from the lowered position to the raised position, the inner surface of the front elbow section 112 of the rear conduit 102 slides over the outer surface of the rear elbow section 108 of the front conduit 100, with the seal between the front and rear conduits 100, 102 being maintained by the annular sealing member 114 located about the periphery of the front conduit 100.

The conduit assembly 14 further comprises a chassis for supporting the conduit assembly 14 on a floor surface. The chassis is connected to the front conduit 100 so that the chassis rotates with the front conduit 100 as it is rotated about the first axis A. The chassis extends about the front conduit 100, and may be connected to the front conduit 100 by, for example, a snap fit connection which retains the chassis in a fixed angular position relative to the front conduit 100.

The chassis comprises a body 124, and a pair of wheels 126 supported by the body 124 for rotation relative to the body 124. In this embodiment each wheel 126 is domed-shaped, and rotates about a respective axis of rotation. The axes of rotation are non-parallel and lie in a common plane which is parallel to the outlet port 92 of the main body 12. The axes of rotation are tilted relative to the second axis B so that the wheels 126 converge beneath the body 124 to engage a floor surface. The wheels 126 have a substantially spherical curvature, and are arranged so that the surfaces of the wheels 126 are coincident with a common sphere. The first axis A passes through the center of this sphere, so that a surface of the sphere remains in contact with the floor surface as the conduit assembly 14 is rotated about the first axis A. The upper surface of the body 124 of the chassis has a similar curvature to the wheels 126 so that this surface of the body 124 is also coincident with this sphere.

As illustrated in FIG. 7, abutment of the intermediate member 118 of the rear conduit 102 against the body 124 of the chassis limits in one direction the pivoting movement of the rear conduit 102 relative to the front conduit 100. To allow the rear conduit 102 to be raised to the position shown in FIGS. 5 to 7 while allowing the chassis to be located adjacent the rear conduit 102, the body 124 of the chassis includes a recessed portion 128 located adjacent the rear conduit 102. As the rear conduit 102 is pivoted towards the raised position, the rear conduit 102 moves into the recess defined by the body 124 of the chassis. The recess thus allows the rear conduit 102 to move freely towards the raised position shown in FIGS. 5 and 7, and is shaped so that the rear conduit 102 does not abut the chassis until the rear section 116 of the rear conduit 102 is substantially vertical.

To inhibit the ingress of dirt into the body 124 of the chassis through the recess when the rear conduit 102 is not in the raised position, the chassis comprises a shield member 130 which is disposed beneath the recessed portion 128 of the body 124. The shield member 130 is arranged to cover the gap formed beneath the body 124 of the chassis and the rear conduit. The shield member 130 is pivotably connected to the body 124. As illustrated in FIG. 1, the shield member 130 comprises a pair of lugs 132 which are each located within an aperture 134 formed in a respective side surface of the body 124 to allow the shield member 130 to pivot about a third axis C indicated in FIGS. 2 and 4, which passes through the center of the sphere defined by the body 124 and the wheels 126, and intersects orthogonally the first axis A.

The shield member 130 is biased towards the rear conduit 102. In this embodiment, a torsion spring (not shown) or other resilient element is provided between the body 124 and the shield member 130 for urging the shield member 130 towards the rear conduit 102. The biasing force of the resilient element is selected so that the resilient element does not impede unduly the pivoting movement of the rear conduit 102 relative to the front conduit 100, and thus relative to the chassis. Due to the biasing force acting on the shield member 130, the shield member 130 moves with the rear conduit 102 as it pivots between its raised and lowered positions to keep covered the gap between the rear conduit 102 and the body 124 of the chassis.

The shield member 130 preferably has a curved outer surface, with the curvature of the outer surface of the shield member 130 being substantially the same as the curvature of the upper surface of the body 124 of the chassis. This can both enable the shield member 130 to be positioned immediately beneath the upper surface of the body 124 when the rear conduit 102 is in its raised position, and cause minimal disruption to the external, spherical appearance of the chassis when the shield member 130 is exposed as the rear conduit 102 is pivoted away from its raised position.

In use, the rear section 116 of the rear conduit 102 may be connected to the wand of a vacuum cleaning appliance. The vacuum cleaning appliance is switched on to operate a fan unit which draws an air flow through the main body 12 and the conduit assembly 14 of the cleaner head 10. The cleaner head 10 is located on a floor surface or other surface to be treated, and is maneuvered forwards and backwards over that surface using the wand of the appliance. As the cleaner head 10 is maneuvered forwards and backwards, the rear conduit 102 pivots relative to the front conduit 100 about the second axis B so that the cleaner head 10 maintains a flat profile with the cleaning surface, and the moveable section 22 of the main body 12 pivots relative to the rear section 20 to maintain the sole plate 26, or the wheels 40, 42 of the sole plate, in contact with the floor surface. Steering of the cleaner head 10 is achieved by rotating the wand, which in turn causes the conduit assembly 14 to rotate about the first axis A so that the cleaner head 10 moves to the right or left in response to clockwise or anticlockwise rotation of the wand of the cleaning appliance.

As the cleaner 10 is maneuvered forwards and backwards, the wheels 126 of the chassis rotate to provide a rolling support for the conduit assembly 14. In response to steering of the cleaner head 10, the front conduit 100, and therefore the chassis, rotates about the first axis A. As the chassis rotates, one of the two wheels 126 maintains contact with the floor surface and thus continues to provide rolling support for the conduit assembly 14. As the surfaces of the wheels 126 are coincident with a common sphere, the center of which is coincident with the first axis A, the wheels 126 continue to support the front conduit 100 at the same height above the floor surface so that no lifting of the cleaner head 10 occurs and a flat profile with the floor surface is maintained.

The invention claimed is:

1. A cleaner head for a surface treating appliance, comprising:

a main body having a fluid port located at the rear of the main body;

a front conduit comprising a front section connected to the main body for rotation relative thereto about a first axis extending rearwardly from the main body and through the fluid port and the front section, a rear elbow section and at least one first connector;

a rear conduit comprising a front elbow section moveable within or about the rear elbow section of the front conduit, a rear section and at least one second connector connected to said at least one first connector to enable the rear conduit to pivot relative to the front conduit about a second axis which is orthogonal to the first axis and which lies outside a fluid flow path passing through the front conduit and the rear conduit; and a chassis for supporting the front conduit on a surface, the chassis being connected to the front conduit for rotation therewith about the first axis.

2. The cleaner head of claim 1, wherein the elbow sections have substantially the same curvature.

3. The cleaner head of claim 1, wherein the front elbow section of the rear conduit is inserted into the rear elbow section of the front conduit.

4. The cleaner head of claim 3, wherein the inner surface of the front elbow section of the rear conduit slides over the outer surface of the rear elbow section of the front conduit as the rear conduit pivots relative to the front conduit.

5. The cleaner head of claim 1, wherein each elbow section has a generally 90° curvature.

6. The cleaner head of claim 1, wherein each conduit comprises a curved intermediate section located between the front section and the rear section thereof.

7. The cleaner head of claim 6, wherein each intermediate section has a curvature in the range from 40 to 50°.

8. The cleaner head of claim 1, wherein said at least one first connector comprises a pair of arms which extend towards the rear conduit, and said at least one second connector comprises a shaft which is received between the arms.

9. The cleaner head of claim 1, wherein the chassis extends about the front conduit.

10. The cleaner head of claim 1, wherein the chassis comprises a body, and a pair of wheels supported by the body.

11. The cleaner head of claim 10, wherein the body of the chassis comprises a recessed portion for receiving the rear conduit with pivoting movement thereof about the second axis.

12. The cleaner head of claim 11, comprising a shield member disposed between the recessed portion of the body and the rear conduit.

13. The cleaner head of claim 12, wherein the shield member is pivotably connected to the body.

14. The cleaner head of claim 13, wherein the shield member is pivotable about a third axis which intersects orthogonally the first axis.

15. The cleaner head of claim 13, wherein the shield member is biased towards the rear conduit.

16. The cleaner head of claim 12, wherein the shield member and the recessed portion of the body each have a curved outer surface.

17. The cleaner head of claim 16, wherein the curvature of the outer surface of the shield member is substantially the same as the curvature of the recessed portion of the body.

18. The cleaner head of claim 16, wherein the wheels are dome-shaped.

19. The cleaner head of claim 18, wherein the wheels have a substantially spherical curvature.

20. The cleaner head of claim 19, wherein the curvature of the outer surface of the wheels is substantially the same as the curvature of the outer surface of the recessed portion of the body.

21. A cleaner head for a surface treating appliance, comprising:

a main body having a fluid port located at the rear of the main body;

a front conduit comprising a front section connected to the main body for rotation relative thereto about a first axis extending rearwardly from the main body and through the fluid port and the front section, a rear elbow section and at least one first connector; and a rear conduit comprising a front elbow section moveable within or about the rear elbow section of the front conduit, a rear section and at least one second connector connected to said at least one first connector to enable the rear conduit to pivot relative to the front conduit about a second axis which is orthogonal to the first axis and which lies outside a fluid flow path passing through the front conduit and the rear conduit, wherein said at least one first connector comprises a pair of arms which extend towards the rear conduit, and said at least one second connector comprises a shaft which is received between the arms.

22. A cleaner head for a surface treating appliance, comprising:

a main body having a fluid port located at the rear of the main body;

a front conduit comprising a front section connected to the main body for rotation relative thereto about a first axis extending rearwardly from the main body and through the fluid port and the front section, a rear elbow section and at least one first connector;

a rear conduit comprising a front elbow section moveable within or about the rear elbow section of the front conduit, a rear section and at least one second connector connected to said at least one first connector to enable the rear conduit to pivot relative to the front conduit about a second axis which is orthogonal to the first axis and which lies outside a fluid flow path passing through the front conduit and the rear conduit; and a chassis for supporting the front conduit on a surface, the chassis being connected to the front conduit for rotation therewith about the first axis, wherein the chassis comprises a body, and a pair of wheels supported by the body, and wherein the body of the chassis comprises a recessed portion for receiving the rear conduit with pivoting movement thereof about the second axis.

* * * * *